US005281937A

United States Patent [19]

Young

[11] Patent Number: 5,281,937

[45] Date of Patent: Jan. 25, 1994

[54] ELECTROMAGNETIC CONTACTOR AND METHOD FOR MAKING SAME

[75] Inventor: Kevin L. Young, Logansport, Ind.

[73] Assignee: Fasco Industries, Inc., Eldon, Mo.

[21] Appl. No.: 913,307

[22] Filed: Jul. 14, 1992

[51] Int. Cl.[5] ..... H01H 67/02

[52] U.S. Cl. ..... 335/132; 335/202

[58] Field of Search ..... 335/132, 131, 202; 200/304, 305

[56] References Cited

U.S. PATENT DOCUMENTS

| | | | |
|---|---|---|---|
| 3,179,771 | 4/1965 | McGary . | |
| 3,215,800 | 11/1965 | Hurter et al. . | |
| 3,235,686 | 2/1966 | Gribble et al. . | |
| 3,251,964 | 5/1966 | Lawrence et al. . | |
| 3,324,431 | 6/1967 | Cataldo et al. . | |
| 3,325,690 | 6/1967 | Kruzic et al. . | |
| 3,388,353 | 6/1968 | Isler . | |
| 3,409,851 | 11/1968 | Schieb et al. . | |
| 3,430,014 | 2/1969 | Walters et al. . | |
| 3,480,892 | 11/1969 | Horii . | |
| 3,501,723 | 3/1970 | Marien . | |
| 3,525,961 | 8/1970 | Marien . | |
| 3,553,613 | 1/1971 | Turnbull et al. . | |
| 3,553,614 | 1/1971 | Whiting et al. . | |
| 3,553,615 | 1/1971 | Turnbull . | |
| 3,560,901 | 2/1971 | Horii et al. . | |
| 3,643,187 | 2/1972 | Stallman et al. . | |
| 3,643,190 | 2/1972 | Puetz et al. . | |
| 3,648,203 | 3/1972 | Kane . | |
| 3,806,849 | 4/1974 | Hughes . | |
| 3,812,440 | 5/1974 | Cook . | |
| 3,993,971 | 11/1976 | Ono et al. . | |
| 4,025,883 | 5/1977 | Slade et al. . | |
| 4,086,550 | 4/1978 | Conner . | |
| 4,117,428 | 9/1978 | Streich et al. . | |
| 4,117,429 | 9/1978 | Streich et al. . | |
| 4,253,076 | 2/1981 | Guery et al. . | |
| 4,254,316 | 3/1981 | Landow . | |
| 4,254,391 | 3/1981 | Gould . | |
| 4,281,305 | 7/1981 | Weeks . | |
| 4,345,224 | 8/1982 | Lenzing . | |
| 4,345,225 | 8/1982 | Lemmer . | |
| 4,370,636 | 1/1983 | Van Patten . | |
| 4,371,855 | 2/1983 | Lenzing . | |
| 4,400,672 | 8/1983 | Bottelson . | |
| 4,423,399 | 12/1983 | Goodrich . | |
| 4,431,978 | 2/1984 | Lenzing . | |
| 4,479,102 | 10/1984 | Marien et al. . | |
| 4,525,694 | 6/1985 | Dennison et al. . | |
| 4,565,986 | 1/1986 | Otsuka et al. . | |
| 4,565,987 | 1/1986 | Otsuka et al. . | |
| 4,626,813 | 12/1986 | Koga et al. | 335/202 |
| 4,644,308 | 2/1987 | Guery et al. | 335/128 |
| 4,647,886 | 3/1987 | Schmiedel . | |
| 4,688,011 | 8/1987 | Lemmer et al. . | |
| 4,710,740 | 12/1987 | Dennison . | |
| 4,719,542 | 1/1988 | Lemmer | 361/417 |
| 4,724,410 | 2/1988 | Degenhart . | |
| 4,734,669 | 3/1988 | Maenishi et al. . | |
| 4,739,293 | 4/1988 | Hurley et al. . | |
| 4,745,382 | 5/1988 | Dittmann . | |
| 4,760,364 | 7/1988 | Ostby . | |
| 4,837,538 | 6/1989 | Dittmann . | |
| 4,945,328 | 7/1990 | Kinney et al. . | |
| 4,951,018 | 8/1990 | Schmiedel et al. . | |
| 4,969,844 | 11/1990 | Sako et al. . | |
| 4,992,765 | 2/1991 | Hirota et al. . | |
| 5,023,581 | 6/1991 | Sugiyama . | |

*Primary Examiner*—Lincoln Donovan
*Attorney, Agent, or Firm*—Lorusso & Loud

[57] ABSTRACT

An electromagnetic contactor comprising a housing, the housing being adapted to receive internally thereof a stationary armature, a coil subassembly, return springs, and a block subassembly, the block subassembly comprising a block adapted to receive terminals and a carrier subassembly, the carrier subassembly comprising a carrier member adapted to receive and retain a movable armature, the housing having internally thereof a plurality of detents adapted to be overridden by the block subassembly and to snap over exposed surfaces of the block subassembly to lock the block subassembly, the stationary armature, and the coil assembly in the housing, whereby to complete assembly of the contactor without fasteners; and a method for making the contactor.

13 Claims, 8 Drawing Sheets

ELECTROMAGNETIC CONTACTOR AND METHOD FOR MAKING SAME

BACKGROUND OF THE INVENTION

1. Field of the Invention

This invention relates to electromagnetic contactors and is directed more particularly to an electromagnetic contactor adapted for assembly without fasteners, such as screws or rivets, and a method for making same.

2. Description of the Prior Art

An electrical contactor is a switch that is adapted to open and close repeatedly to supply and interrupt electricity at power levels to electrical loads, such as motors and the like. An electromagnetic contactor is a contactor that is caused to operate by an electromagnet.

An example of eleotromagnetic contactors is given in U.S. Pat. No. 3,643,187 issued Feb. 15, 1972, in the names of James E. Stallman, et al., which teaches contacts that are brought into engagement by energizing an electromagnet and that are separated by the force of a spring when current is interrupted to the electromagnet. The apparatus disclosed in the '187 patent is assembled by screws and rivets, which renders a manufacturing process, including automatic assembly or assembly by robots, unduly complex.

U.S. Pat. No. 3,235,686, issued Feb. 15, 1966, in the names of Joseph J. Gribble, et al., discloses a contactor having facility for access to the contacts for service without disconnecting the power wires to the contactor. While such feature represents an advantage in operations, the device disclosed in the '686 patent is assembled by screws and is, therefore, difficult to assemble automatically.

U.S. Pat. No. 3,179,771, issued Apr. 20, 1965 in the name of Robert L. McGary, teaches an exposed external electromagnet and return spring. The structure taught in the '771 patent is assembled by screws and rivets and is difficult to adapt to automatic assembly.

U.S. Pat. No. 4,525,694, issued Jun. 25, 1985, in the names of William G. Dennison, et al., features a three-pole contactor that is assembled without the use of screws or rivets. The apparatus taught in the '694 patent has a separate mounting and supporting frame that is snapped to the housing of the contactor to facilitate mounting of the contactor. The '694 patent also features contacts held in place by a spring snap.

Pat. No. 4.951,018, issued Aug. 21, 1990 to James P. Schmiedel, et al., relates to an electromagnetic contactor adapted to be assembled without fasteners. In Schmiedel, a base or clip member snaps into a housing to hold components in the housing. The base or clip member is provided with two flexible prongs having oppositely-extending portions which snap into the housing. In an alternative embodiment, Schmiedel provides a housing with outwardly-protruding detents which snap into slots in a base member.

SUMMARY OF THE INVENTION

An object of the invention is to provide an electromagnetic contactor which easily may be assembled without the need of fasteners and which, therefore, is adapted for easy assembly by relatively unskilled workers, resulting in reduced costs, and is further adapted for automatic assembly in production.

With the above and other objects in view, as will hereinafter appear, a feature of the present invention is the provision of an electromagnetic contactor comprising a housing, the housing being adapted to slidingly receive internally thereof a stationary armature, a coil, return springs, and a block subassembly, the block subassembly comprising a block adapted to slidingly receive a pair of terminals, and a carrier subassembly, the carrier subassembly comprising a carrier member adapted to receive a movable armature, a movable contact bar, an overtravel spring, and a retainer cap, the housing having internally thereof a plurality of detents adapted to be overridden by the block subassembly and to lock over exposed surfaces of the block subassembly to lock the block subassembly, the stationary armature, and the coil in the housing.

In accordance with a further feature of the invention, there is provided a method for making an electromagnetic contactor, the method comprising the steps of providing a non-conductive housing with detents internally thereof, inserting a stationary armature and a coil into the housing, positioning return springs in the housing with first ends thereof abutting the coil, providing a block subassembly having holes therein adapted to receive second ends of the return springs and having surfaces adapted to receive the detents in locking engagement, inserting the block subassembly into the housing with the block subassembly holes receiving the send ends of the return springs, and sliding the block subassembly into the housing until the detents snap over the block subassembly surfaces to lock the stationary armature, the coil, the return springs, and the block subassembly in the housing, thereby to assemble the contactor.

The above and other features of the invention, including various novel details of construction and combinations of parts, will now be more particularly described with reference to the accompanying drawings and pointed out in the claims. It will be understood that the particular device and method embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
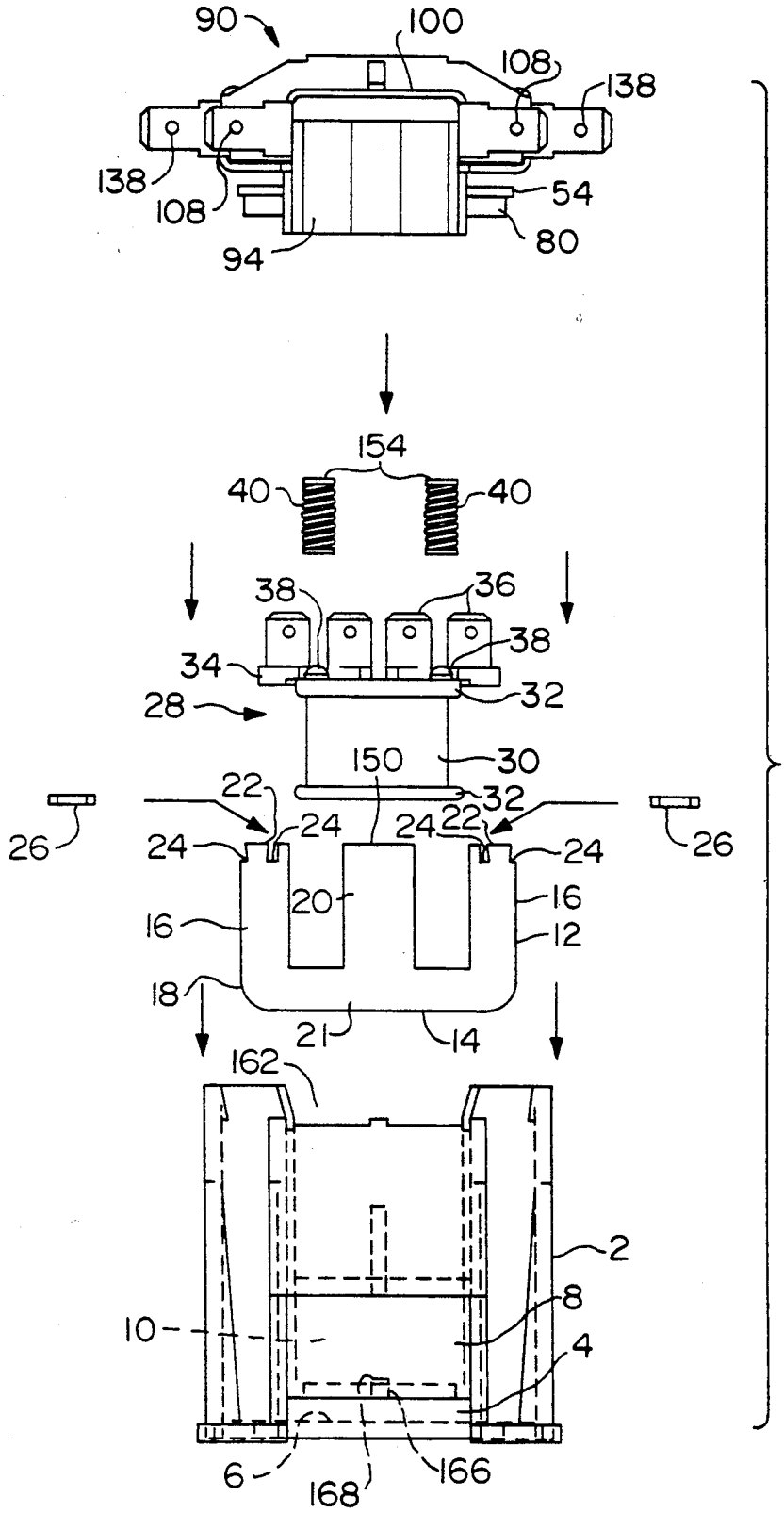
FIG. 1 is an exploded elevational view illustrative of an embodiment of the invention.

Referring to FIGS. 1, 4, 4A and 5, it will be seen that the inventive electromagnetic contactor includes a nonconductive housing 2 having walls 4 in part defining an elongated first chamber 6 (FIGS. 4 and 4A), and rounded walls 8 defining a second chamber 10. The contactor further includes a stationary armature 12 (FIG. 1), which includes a base portion 14, an arm 16 upstanding from either end 18 of the base portion 14, and a core portion 20 upstanding from a central area 21 of the base portion 14. The stationary armature 12 preferably is formed by a lamination stack, known in the art.

Each free end 22 of the stationary armature arms 16 is provided with notches 24 into which may be staked copper shading rings 26 (FIG. 1).

A coil assembly 28 includes copper wire 30 wound upon a bobbin 32. Fixed to the bobbin 32 are non-conductive support plates 34 from which extend terminals 36. Extending from one end of the bobbin 32 are two protrusions 38, each adapted to receive a return coil spring 40.

In assembly, the stationary armature 12, with the shading rings 26 thereon, is slid into the housing 2, with the base portion 14 of the stationary armature 12 being received in the housing first chamber 6. The bobbin 32 is slid over the core portion 20 of the stationary armature 12 and between the armature arms 16. Alternatively, the coil assembly 28 and the stationary armature 12 may be put together and, as a unit, inserted in the housing 2. The return coil springs 40 may be fitted onto the protrusions 38 before or after the coil assembly 28 and the stationary armature 12 are inserted into the housing 2.

Figure 8:
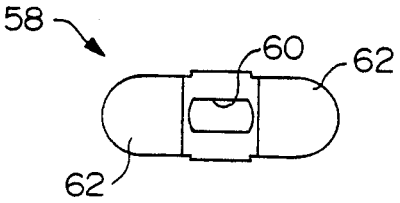
FIG. 8 is a top plan view of a movable contact bar portion of the contactor.
Figure 9:
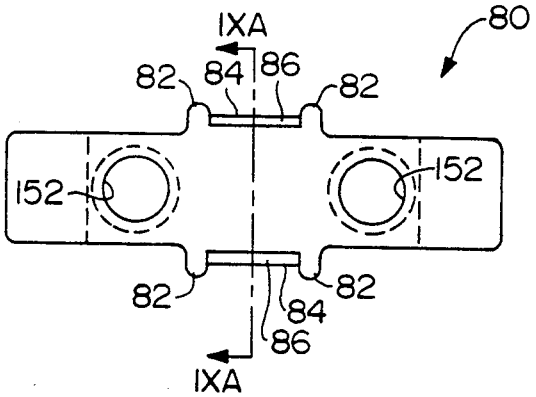
FIG. 9 is a top plan view of a movable armature portion of the contactor.
Figure 9A:
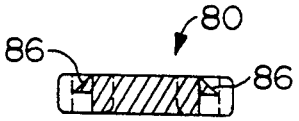
FIG. 9A is a sectional view taken along line IX-A—IXA of FIG. 9.

Referring to FIGS. 2, 2A, 6 and 7, it will be seen that the electromagnetic contactor includes a carrier subassembly 50 which, in turn, includes a carrier member 52 comprising a base plate 54 and upstanding therefrom a post 56. An elongated movable contact bar 58 (FIGS. 2, 2A and 8) has an opening 60 centrally thereof (FIG. 8) which is adapted to receive the post 56, and which facilitates sliding of the contact bar 58 on the post 56. The contact bar 58 has a contact 62 mounted on either end thereof. An overtravel coil spring 64 (FIGS. 2 and 2A) is disposed on the post 56 with a first end 66 of the spring 64 abutting the contact bar 58. A retainer cap 68 (FIGS. 2 and 2A) snaps onto a free end 70 (FIG. 2) of the post 56 and engages a second end 72 of the spring 64.

The base plate 54 of the carrier member 52 includes opposed depending lugs 74 which define a cavity 76 (FIG. 7) on an underside 78 of the base plate 54 into which may be snapped a movable armature 80 (FIGS. 2, 2A, 9 and 9A). The armature 80 comprises a substantially planar metal member with detents 82 (FIG. 9) centrally thereof defining pockets 84 adapted to receive the lugs 74 (FIG. 7) to lock the armature 80 onto the carrier member 52. Each of the pockets 84 is defined in part by a tapered flange 86 (FIG. 9A) which may be pressed over the lugs 74 and into the cavity 76.

In assembly (FIG. 2), the armature 80 is snapped into the cavity 76 on the underside 78 of the carrier member base plate 54. The contact bar 58 and the overtravel coil spring 64 are fitted upon the post 56 and the carrier subassembly 50 locked together by snapping the retainer cap 68 onto the free end 70 of the post 56.

There is provided a block subassembly 90 (FIGS. 3 and 3A), which includes a nonconductive terminal block 92 having therein an opening 94 leading to a cavity 96 in the terminal block 92. The opening 94 is adapted to facilitate sliding of the carrier subassembly 50 into the cavity 96, which is adapted to receive and retain the carrier subassembly 50.

Figure 10:
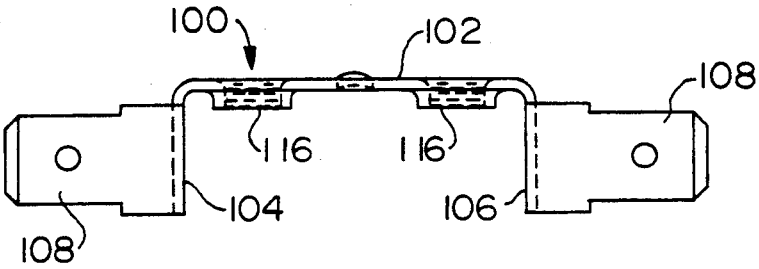
FIG. 10 is a front elevational view of a bus bar portion of the contactor.
Figure 11:
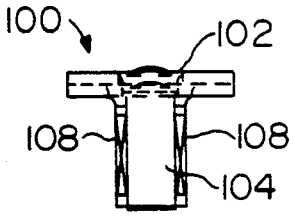
FIG. 11 is an end elevational view of the bus bar portion of FIG. 10.

The block subassembly 90 may optionally include a bus bar 100 (FIGS. 3A, 10 and 11) which comprises a substantially U-shaped member having a base portion 102 (FIGS. 10 and 11) and first and second leg portions 104. 106, and a pair of quick-connect terminals 108 fixed to each of the leg portions 104, 106. A first pair of the quick connect terminals 108 is fixed to the first leg portion 104 and extends outwardly from the first leg portion 104 in a direction opposite to the direction in which extends a second pair of the quick-connect terminals 108 fixed to the second leg portion 106. To connect the bus bar 100 to the block 92, the base portion 102 of the bus bar is slid onto a surface 112 and beneath a rib 114 (FIG. 3A). Threaded extrusions 116 (FIG. 10) on the underside of the base portion 102 slide into complementary open-ended slots 118 in the surface 112 (FIG. 3A). The bus bar 100 is held by friction between the surface 112 and the rib 114. The housing 2 is provided with open-ended slots 110 (FIGS. 4 and 4A) adapted to receive the bus bar quick-connect terminals 108.

Figure 2A:
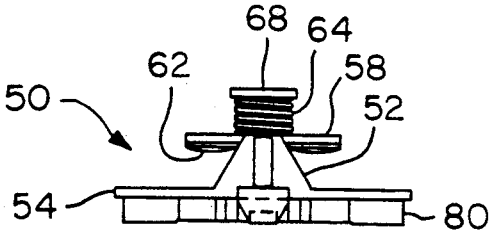
FIG. 2A is a side elevational view of the assembled carrier subassembly portion.
Figure 2:
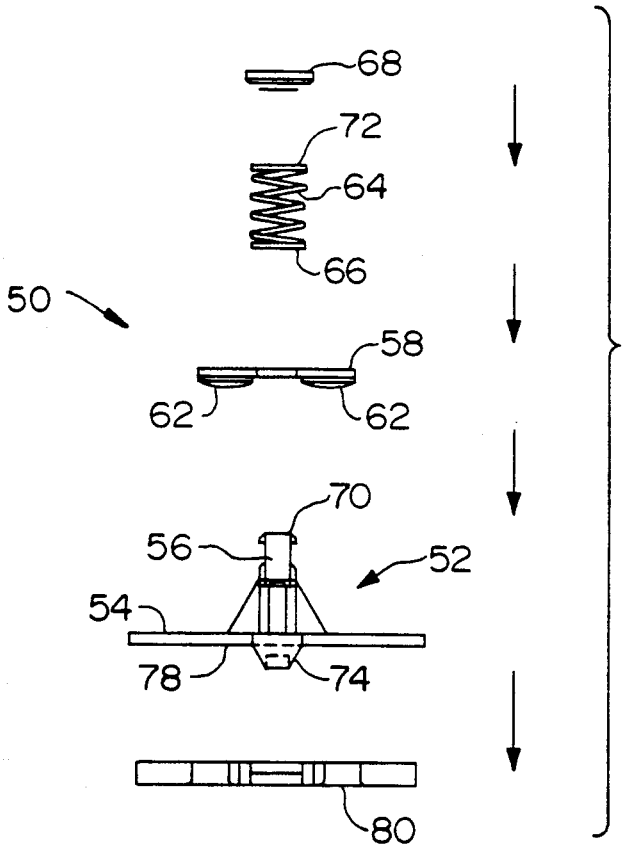
FIG. 2 is an exploded elevational view illustrative of a carrier subassembly portion of the inventive contactor.
Figure 3:
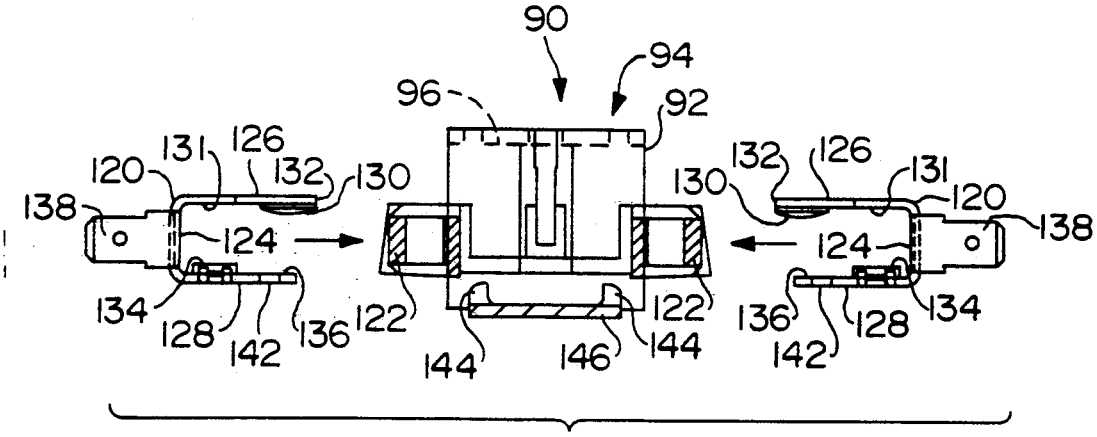
FIG. 3 is an exploded view, partly elevational and partly in section, of members of a block subassembly portion of the contactor.
Figure 3A:
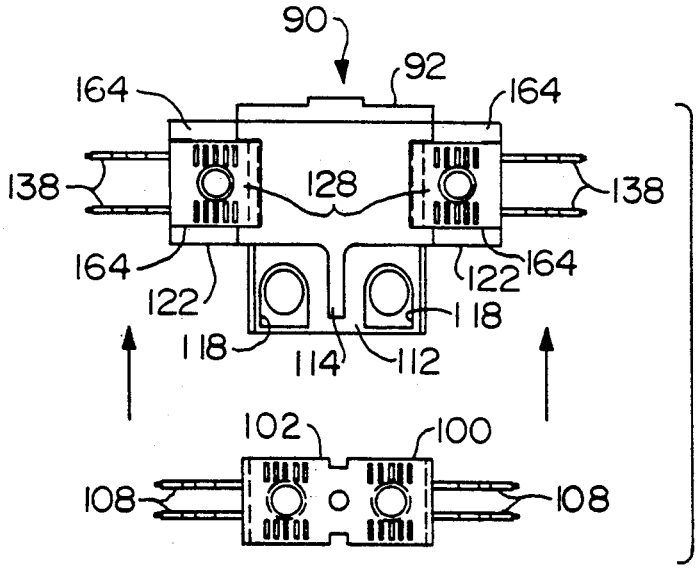
FIG. 3A s a top plan view of the members of FIG. 3 connected together, and showing in exploded fashion an optional additional component.
Figure 4:
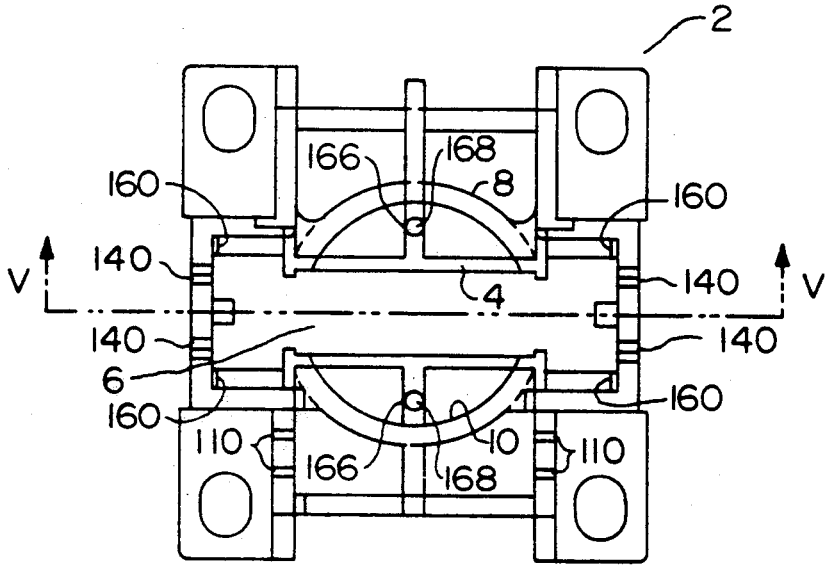
FIG. 4 is a top plan view of a housing portion of the contactor.
Figure 4A:
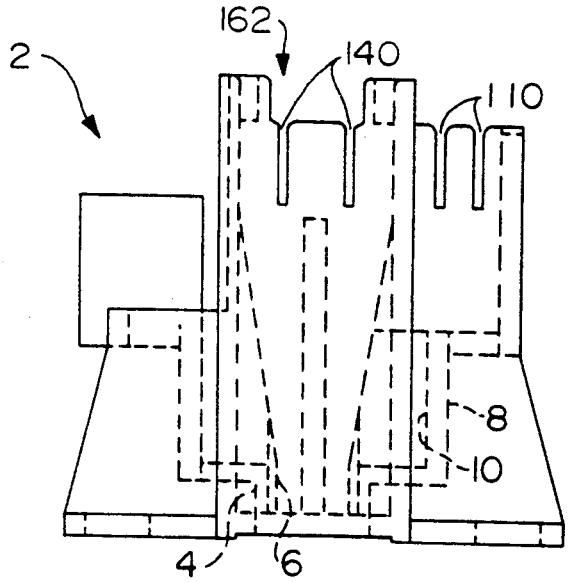
FIG. 4A is a side elevational view of the housing portion of FIG. 4.
Figure 5:
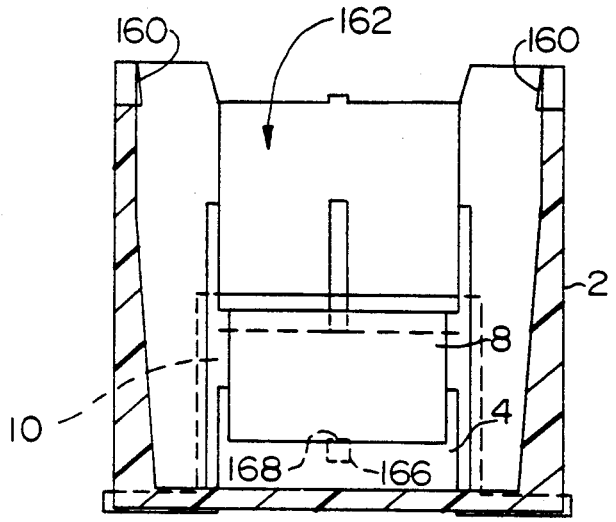
FIG. 5 is a sectional view of the housing portion, taken along line V–V of FIG. 4.
Figure 6:
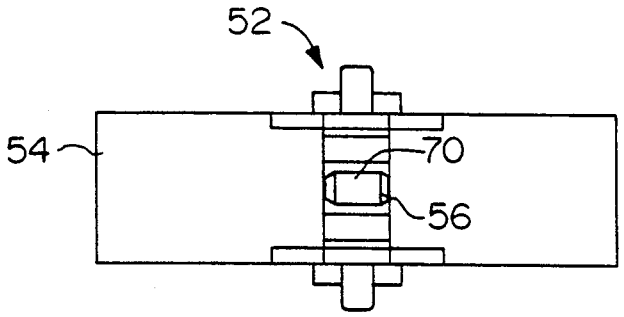
FIG. 6 is a top plan view of a carrier portion of the contactor.
Figure 7:
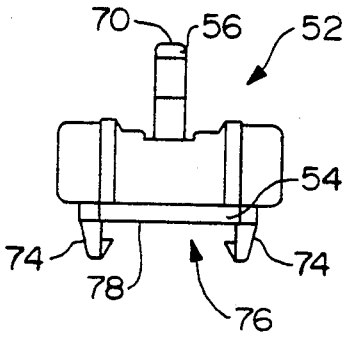
FIG. 7 is an end elevational view of the carrier portion shown in FIG. 6.
Figure 12:
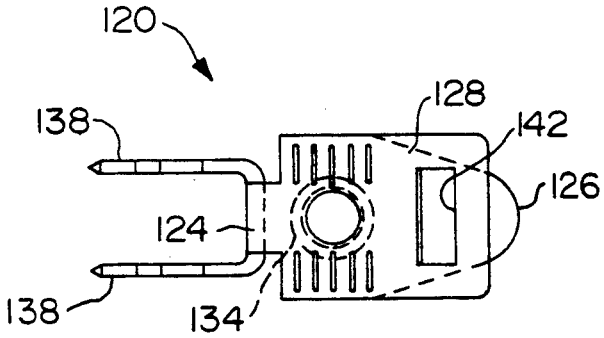
FIG. 12 is a top elevational view of a stationary contact terminal portion of the contactor.
Figure 13:
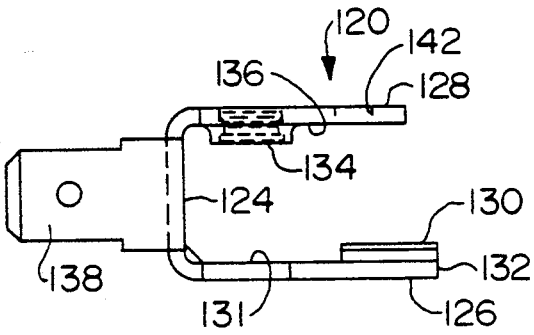
FIG. 13 is a front elevational view of the stationary contact terminal portion of FIG. 12.
Figure 14:
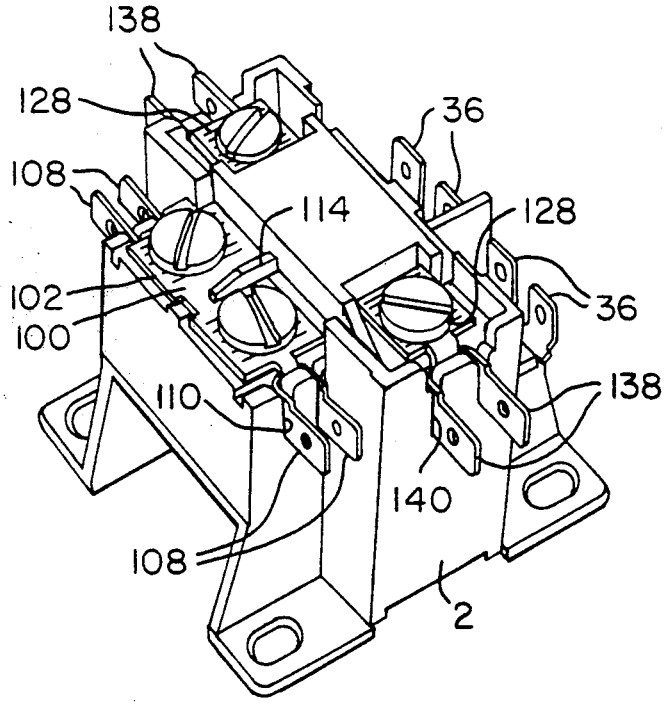
FIG. 14 is a perspective view of the assembled contactor.

A pair of stationary contact terminals 120 are slidable onto outwardly and oppositely extending ear portions 122 of the terminal block 92 (FIG. 3). Each of the stationary contact terminals 120 comprises a U-shaped blade having a base portion 124 (FIGS. 12 and 13) and first and second leg portions 126, 128, a contact 130 being disposed on an inboard surface 131 of the first leg portion 126 proximate a free end 132 of the first leg portion 126 (FIG. 13). A threaded screw extrusion 134 is disposed on an inboard surface 136 of the second leg portion 128 proximate the contact base portion 124. A pair of quick-connect terminals 138 extend from the contact base portion 124 in a direction opposite to the direction in which extend the first and second leg portions 126, 128. The first and second leg portions 126, 128 are substantially planar; the quick-connect terminals 138 are substantially planar, and the planes of the leg portions 126, 128 are substantially normal to the planes of the quick-connect terminals 138. To connect the contact terminals 120 to the terminal block 92, the contact terminals 120 are slid onto the ear portions 122, as shown in FIG. 3. Each of the contact terminals 120 is pushed onto its respective ear portion 122 until a rectangularly-shaped opening 142 snaps over a detent 144 upstanding from a wall portion 146, which locks the stationary contact terminal 120 on the ear portion 122. In locked-on position the contact 130 is well within the block cavity 96 and, upon completion of assembly, is adapted to be engaged by one of the contact bar contacts 62 (FIGS. 2 and 2A). The contactor housing 2 is provided with open-ended slots 140 adapted to receive the stationary quick connect terminals 138 (FIGS. 4 and 4A).

The combination of the carrier subassembly 50, the bus bar 100, if desired, and the stationary contact terminals 120, produces the block subassembly 90. In assembly, the block subassembly 90 is slid into the housing 2, such that the movable armature 80 is disposed adjacent a free end 150 of the stationary armature core portion 20 (FIG. 1). The movable armature 80 is provided with holes 152 (FIG. 9) which receive ends 154 (FIG. 1) of the return coil springs 40 (FIG. 1).

The housing open-ended slots 110 receive the bus bar quick-connect terminals 108 and the housing open-ended slots 140 receive the stationary contact quick-connect terminals 138. The housing 2 is of a non-conductive material, typically plastic, and is provided with internal detents 160 (FIGS. 4 and 5) proximate an open end 162 of the housing. In the block subassembly 90 (FIG. 3A), the ear portions 122 are provided with surfaces 164, on which are disposed the stationary contact terminal second leg portions 128. Upon placement of the block subassembly 90 in the housing 2, the ear portions 122, which also typically are made of plastic, are adapted to override the detents 160 to permit the detents to snap over the ear surfaces 164, to lock the block subassembly in the housing 2.

The housing 2, at or near the bottom of the second chamber 10, is provided with integrally molded leaf springs 166 (FIGS. 1, 4 and 5) with seats 168 upstanding therefrom and adapted to engage the bottom surface of the bobbin 32 when the contactor components are assembled. The springs 166 urge the bobbin upwardly, as viewed in FIG. 1, such that the components are held snugly together, between the springs 166 and the locking detents 160. Other spring means may be used, as, for example, a coil spring, or an elastomeric padding (not shown).

Thus, the various components of the contactor are assembled without the use of solder, screws or rivets, or other fasteners, facilitating automatic assembly of the contactor. Once assembled, the operation of the contactor comports with the operation of known contactors. Briefly, power lines (not shown) from a high-voltage power source are connected to one set of the stationary contact terminals 120. A second set of power lines (not shown) are connected to another set of the stationary contact terminals 120 and lead to an energy consumer, such as one or more motors. From a relatively low-voltage source (not shown) wires are connected to the terminals 36. When it is desired to interconnect the lines from the high-voltage power source and the lines to the energy consumer, the low-voltage source is switched into communication with the coil 28 which produces a magnetic field with the flux density thereof concentrated by the stationary armature 12. The movable armature 80 is thereby caused to move toward the stationary armature 12, carrying with it the carrier contact bar 58. The contacts 62 on the carrier contact bar 58 engage the contacts 130 on the stationary contact terminals 120, which closes the circuit from one set of stationary contact terminals 120 to the other set of stationary contact terminals 120. When the coil is de-energized, the return springs 40 move the movable armature 80 away from the stationary armature 12, opening the circuit between the stationary contact terminals 120.

When used, the bus bar 100 has attached thereto second power lines between the high-voltage power source and the energy consumer, completing the circuit between the power source and the consumer. The bus bar may be omitted, in which case the second power lines extend from the source to the consumer, without intermediate connection to the contactor.

It is to be understood that the present invention is by no means limited to the particular construction herein disclosed and/or shown in the drawings, but also comprises any modifications or equivalents within the scope of the claims.

For example, the embodiment illustrated and discussed herein is a single pole contactor. However, the same concept applies to a two pole contactor, utilizing four stationary terminals, rather than the illustrated two, two movable contact bars, rather than the illustrated one, and two carrier posts, rather than the illustrated single post. Similarly, the same concept applies to three or more pole contactors.

Having thus described my invention, what I claim as new and desire to secure by Letters Patent of the U.S. is:

1. An electromagnetic contactor comprising a housing, said housing being adapted to slidingly receive internally thereof a stationary armature, a co-, return springs, and a block subassembly, said block subassembly comprising a block adapted to slidingly receive stationary terminal means, and carrier subassembly means, said carrier subassembly means comprising a carrier member adapted to receive a movable armature, said carrier member having a central post upstanding from a base plate, a movable contact bar having a plurality of contacts thereon and slidingly mounted on said post, an overtravel spring disposed around said post, and retainer cap means confining said spring between said contact bar and said cap means, said housing having internally thereof a plurality of detents adapted to be overridden by said block subassembly and to snap over exposed surfaces of said block subassembly to lock said block subassembly, said stationary armature, and said stationary coil in said housing.

2. An electromagnetic contactor comprising a housing, said housing having a first chamber therein, a stationary armature comprising a base portion, an arm portion upstanding from either end of said base portion, and a core portion upstanding from a central area of said base portion, a coil assembly having first terminals fixed thereto, said housing first chamber being adapted to receive said stationary armature base portion, said housing being adapted further to receive said stationary armature arm portions and core portion, each of said arm portions being adapted to receive and retain a shading ring at the distal end of said arm portion, said core portion being adapted to receive said coil assembly therearound, said housing having a rounded second chamber adapted to receive said coil assembly, said first terminals extending from a nonconductive support plate fixed to said coil assembly, two protrusions extending from said support plate and away from said coil assembly, a pair of return coil springs, each of said return coil springs adapted to be mounted at a first end thereof on one of said protrusions, a non-conductive carrier having a carrier base plate and carrier central post means upstanding from said carrier base plate, said carrier post means being adapted to slidingly receive a conductive movable contact bar, said carrier post means being further adapted to receive overtravel coil spring means therearound with a first end of said overtravel coil spring means abutting said movable contact bar, a retainer cap means adapted to attach to a distal end of said carrier post means and abut a second end of said overtravel coil spring means to lock said movable contact bar and said overtravel coil spring means on said carrier post means between said carrier base plate and said retainer cap means, said carrier base plate being adapted to slidingly receive a movable armature on a side of said carrier base plate removed from said carrier post means to form a carrier subassembly, a block adapted to slidingly receive said carrier subassembly and adapted to slidingly receive and retain stationary terminal means, to form a block subassembly, said housing being adapted to receive said block subassembly, said movable armature having a pair of holes therein adapted to receive second ends of said return coil springs, said housing having internally thereof a plurality of detents adapted to be overridden by said block subassembly and to snap over exposed surfaces of said block subassembly to lock said block subassembly, said stationary armature and said stationary coil in said housing.

3. The contactor in accordance with claim 2 wherein said movable contact bar is elongated and has centrally thereof opening means adapted to receive said carrier post means and enabling said contact bar to move along said carrier post means, and a contact mounted at each end of said contact bar.

4. The contactor in accordance with claim 2 wherein each stationary terminal of said stationary terminal means comprises a U-shaped blade having a base portion and first and second leg portions, a first contact being disposed on an inboard surface said first leg proximate a free end of said first leg, a threaded extrusion being disposed on an inboard surface of said second leg proximate said contact base portion, and a pair of quick-connect terminals extending from said contact base portion in a direction opposite to the direction in which extend said first and second leg portions.

5. The contactor in accordance with claim 4 wherein said first and second leg portions are substantially planar, said quick-connect terminals are substantially planar, and the planes of said legs are substantially normal to the planes of said quick-connect terminals.

6. The contactor in accordance with claim 5 wherein said housing is provided with open-ended slots adapted to receive said stationary quick connect terminals.

7. The contactor in accordance with claim 1, wherein said block is adapted to slidingly receive a bus bar, and said block subassembly includes a bus bar mounted on said block.

8. An electromagnetic contactor comprising a housing, said housing being adapted to slidingly receive internally thereof a stationary armature, a coil, return springs, and a block subassembly, said block subassembly comprising a block adapted to slidingly receive stationary terminal means and a bus bar, and carrier subassembly means, said carrier subassembly means comprising a carrier member adapted to receive a movable armature, a movable contact bar, an overtravel spring, and retainer cap means, said housing having internally thereof a plurality of detents adapted to be overridden by said block subassembly and to snap over exposed surfaces of said block subassembly to lock said block subassembly, said stationary armature, and said stationary coil in said housing, said block subassembly including said bus bar mounted on said block, said bus bar comprising a substantially U-shaped member having a base portion and first and second leg portions, and a pair of terminals fixed to each of said leg portions, a first pair of said terminals fixed to said first leg portion and extending outwardly from said first leg portion in a direction opposite to the direction in which extend a second pair of said terminals fixed to said second leg portion.

9. The contactor in accordance with claim 8, wherein said housing is provided with open-ended slots adapted to receive said bus bar terminals.

10. The contactor in accordance with claim 2, wherein said housing second chamber is provided with spring means for shutting said coil assembly, to bias said coil assembly in a direction towards said detents.

11. A method for making an electromagnetic contactor, said method comprising the steps of providing a non-conductive housing with detents internally thereof, inserting a stationary armature and a coil assembly into said housing, positioning return springs in said housing with first ends thereof abutting said coil assembly, providing a block subassembly having holes therein adapted to receive second ends of said return springs and having surfaces adapted to receive said detents in locking engagement, said block assembly including a carrier subassembly, and said method including the additional steps of providing a carrier member having a base plate and post means upstanding therefrom and lugs depending therefrom, mounting a contact bar on said post means, said bar having hole means therein to receive said post means, mounting overtravel spring means on said post means and abutting said contact bar, mounting retainer cap means on a free end of said post means to lock said contact bar and said overtravel spring means on said post means, and mounting an armature on an underside of said carrier base plate, said armature engaging said lugs for retention of said armature, and inserting said carrier subassembly into said block subassembly. inserting said block subassembly into said housing with said block subassembly holes receiving said second ends of said return springs, and sliding said block subassembly into said housing until said detents snap over said block subassembly surfaces to lock said stationary armature, said coil, said return springs, and said block subassembly in said housing, thereby to assemble said contactor.

12. The method in accordance with claim 11 wherein said block subassembly further includes stationary terminals and said method includes the additional steps of providing said block member with means for slidably receiving and retaining said stationary terminals and sliding said stationary terminals into engagement with said block member.

13. The method in accordance with claim 12 wherein said block subassembly further includes a bus bar and said method includes the additional steps of providing said block member with means for slidably receiving and retaining said bus bar, and sliding said bus bar into engagement with said block member.

* * * * *

UNITED STATES PATENT AND TRADEMARK OFFICE
CERTIFICATE OF CORRECTION

PATENT NO. : 5,281,937

DATED : January 25, 1994

INVENTOR(S) : Kevin L. Young

It is certified that error appears in the above-identified patent and that said Letters Patent is hereby corrected as shown below:

Col. 2, line 27, before "ends", delete "send" and insert --second--;

Col. 5, line 53, after "contactor.", begin a new paragraph;

Col. 6, line 34, before "return", delete "co-" and insert --coil--;

Col. 7, line 40, before "said", insert "of";

Col. 8, line 21, after "for", delete "shutting" and insert --abutting--.

Signed and Sealed this

Twentieth Day of September, 1994

*Attest:*

Bruce Lehman

BRUCE LEHMAN

*Attesting Officer*

*Commissioner of Patents and Trademarks*